US005730033A

United States Patent [19]

Mitrowski

[11] Patent Number: 5,730,033

[45] Date of Patent: Mar. 24, 1998

[54] FLORESCENT LIGHT BULB CHANGING DEVICE

[76] Inventor: Anthony D. Mitrowski, 13311 Wilson St., Garden Grove, Calif. 92644-1815

[21] Appl. No.: 695,113

[22] Filed: Aug. 8, 1996

[51] Int. Cl.[6] ..... H01K 3/32

[52] U.S. Cl. ..... 81/53.11; 81/302; 81/424.5; 81/426.5; 294/19.1

[58] Field of Search ..... 81/53.1, 53.11, 81/53.12, 302, 342, 384, 395, 416–417, 424.5, 426.5, 427; 294/19.1, 22

[56] References Cited

U.S. PATENT DOCUMENTS 2,191,593 2/1940 Sosnik et al. ..... 81/53.11
2,544,707 3/1951 Margolis ..... 81/53.11
2,716,043 8/1955 Baril ..... 294/22 X
3,129,970 4/1964 St-John ..... 81/53.11

*Primary Examiner*—D. S. Meislin

[57] ABSTRACT

A florescent light bulb changing device comprises a gripper assembly including first and second gripper members, each gripper member including a jaw section, a handle section and a central coupling section, the central coupling section of the gripper members being pivotally coupled to each other; and a tension spring including first and second linear end portions and a coiled central portion, the first linear end portion being positioned within the handle section of the first gripper member, the second linear end portion being positioned within the handle section of the second gripper member, the tension spring functioning to urge the jaws toward each other.

4 Claims, 3 Drawing Sheets

FLORESCENT LIGHT BULB CHANGING DEVICE

BACKGROUND OF THE INVENTION

1. Field of the Invention

The present invention relates to a florescent light bulb changing device and more particularly pertains to extracting and replacing florescent light bulbs with the apparatus.

2. Description of the Prior Art

The use of light bulb removers is known in the prior art. More specifically, light bulb removers heretofore devised and utilized for the purpose of extracting various types of light bulbs are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,864,899 to Morse discloses an illuminating light bulb remover.

U.S. Pat. No. 4,719826 to DuBois discloses a light bulb extractor.

U.S. Pat. No. Des. 297,499 to Whitney discloses a light bulb remover.

U.S. Pat. No. Des. 350,892 to Sorenson discloses a spring clamp.

U.S. Pat. No. 4,034,542 to Loehr discloses fruit picking implements.

U.S. Pat. No. 5,317,939 to Marinescu discloses a light bulb changing device.

U.S. Pat. No. 4,096,630 to Honick discloses a pole pruner.

U.S. Pat. No. 4,760,645 to Davis discloses a pole mounted pruning tool with adjustable length operating lever.

U.S. Pat. No. 5,241,752 to Lutzke et al. discloses a pruning tool.

While these devices fulfill their respective, particular objective and requirements, the aforementioned patents do not describe a florescent light bulb changing device for extracting and replacing florescent light bulbs.

In this respect, the florescent light bulb changing device according to the present invention substantially departs from the conventional concepts and designs of the prior art, and in doing so provides an apparatus primarily developed for the purpose of extracting and replacing florescent light bulbs.

Therefore, it can be appreciated that there exists a continuing need for new and improved florescent light bulb changing device which can be used for extracting and replacing florescent light bulbs. In this regard, the present invention substantially fulfills this need.

SUMMARY OF THE INVENTION

In the view of the foregoing disadvantages inherent in the known types of light bulb removers now present in the prior art, the present invention provides an improved florescent light bulb changing device. As such, the general purpose of the present invention, which will be described subsequently in greater detail, is to provide a new and improved florescent light bulb changing device and method which has all the advantages of the prior art and none of the disadvantages.

To attain this, the present invention essentially comprises a new and improved florescent light bulb changing device adapted for use in association with at least one vertically positioned florescent light tube, each florescent light tube being coupled within a florescent light tube housing, the apparatus comprising, in combination: a gripper assembly including a first gripper member and a second gripper member, each gripper member including a jaw section, a handle section and a central coupling section, each jaw section having an axis and being formed in an elongated semicylindrical configuration with an outboard end, a concave inner surface and a convex outer surface, a soft rubber jaw cushion being tightly coupled around each jaw section, the soft rubber jaw cushions following the contour of the jaw sections, the jaw sections being sized and shaped to securely grip a florescent light tube therewithin, the soft rubber construction of the jaw cushions preventing damage to a gripped florescent light tube, each central coupling section being formed of opposing extension members, each extension member including a hole extending therethrough, a pivot pin pivotally coupling the opposing extension members of each central coupling section; the handle section of the second gripper member being formed in a hollow cylindrical configuration with a lower end including internal screw threads, the handle section of the second gripper member having an axis parallel to the axis of the jaw section of the second gripper member, the handle section of the first gripper member being formed in a semicylindrical configuration and having a curved axis angled outwardly with respect to the axis of the jaw section of the first gripper member, the handle section of the first gripper member including a lower end and a central threaded hole; a tension adjustment assembly including a tension spring, an adjustable bolt and a nut, the tension spring including first and second linear end portions and a coiled central portion, the coiled central portion of the tension spring being positioned around the pivot pin and secured between the extension members, the second linear end portion being securely positioned within the handle section of the second gripper member, the adjustable bolt having a head and an inboard end and coupled through the threaded hole of the handle section of the first gripper member, a nut being positioned around the bolt to secure it in place, the inboard end including a U-shaped member, the first linear end portion being wedged within the U-shaped member, the tension spring functioning to urge the jaws toward each other and the handle sections away from each other, the adjustable bolt permitting a user to change the distance between the jaws by turning the bolt; a pulley assembly including a large pulley wheel, a small pulley wheel and a braided wire cable, the large pulley wheel being rotatably coupled to the handle section of the second gripping member, the large pulley wheel having a rod with an outer end extending therefrom, the small pulley wheel being affixed to the outer end of the rod a short distance from the first gripper member, the cable having a first end and a second end, the first end being coupled to the lower end of the handle section of the first gripper member, the cable being wound around the large and small pulley wheels, in an operative orientation a user pulling the lower end of the cable thereby urging the first and second handle sections toward each other, this action thereby pivoting the jaw sections apart into an open orientation; and an extension pole formed in an elongated generally cylindrical configuration with an upper end including external screw threads, in an operative orientation the upper end of the pole being threadedly coupled within the lower end of the handle section of the second gripper member, the pole being of sufficient length to enable users to access ceiling mounted florescent bulbs with the apparatus.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved florescent light bulb changing device which has all the advantages of the prior art light bulb removers and none of the disadvantages.

It is another object of the present invention to provide a new and improved florescent light bulb changing device which may be easily and efficiently manufactured and marketed.

It is a further object of the present invention to provide a new and improved florescent light bulb changing device which is of durable and reliable construction.

An even further object of the present invention is to provide a new and improved florescent light bulb changing device which is susceptible of a low cost of manufacture with regard to both materials and labor, and which accordingly is then susceptible of low prices of sale to the consuming public, thereby making such a florescent light bulb changing device economically available to the buying public.

Still yet another object of the present invention is to provide a new and improved florescent light bulb changing device which provides in the apparatuses and methods of the prior art some of the advantages thereof, while simultaneously overcoming some of the disadvantages normally associated therewith.

Even still another object of the present invention is to provide a new and improved florescent light bulb changing device for extracting and replacing florescent light bulbs.

Lastly, it is an object of the present invention to provide a new and improved a florescent light bulb changing device comprising: a gripper assembly including first and second gripper members, each gripper member including a jaw section, a handle section and a central coupling section, the central coupling section of the gripper members being pivotally coupled to each other; and a tension spring including first and second linear end portions and a coiled central portion, the first linear end portion being positioned within the handle section of the first gripper member, the second linear end portion being positioned within the handle section of the second gripper member, the tension spring functioning to urge the jaws toward each other.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
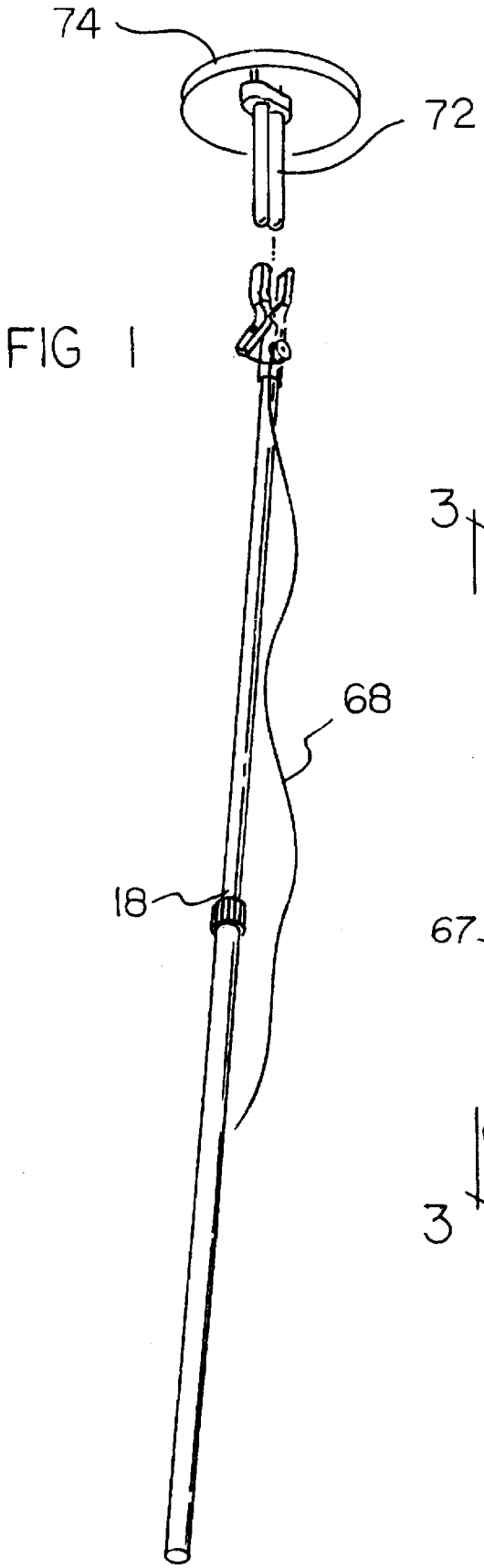
FIG. 1 as a perspective view of the preferred embodiment of the florescent light bulb changing device constructed in accordance with the principles of the present invention.

With reference now to the drawings, and in particular, to FIG. 1 thereof, the preferred embodiment of the new and improved florescent light bulb changing device embodying the principles and concepts of the present invention and generally designated by the reference number 10 will be described.

Specifically, it will be noted in the various Figures that the device relates to a florescent light bulb changing device for extracting and replacing florescent light bulbs. In its broadest context, the device consists of a gripper assembly 12, a tension adjustment assembly 14, a pulley assembly 16 and an extension pole 18. Such components are individually configured and correlated with respect to each other so as to attain the desired objective.

The florescent light bulb changing device is adapted for use in association with florescent light tubes 72 formed in an elongated cylindrical configuration. Most florescent light bulbs are 9–13 Watt, single or twin. The florescent bulbs are adapted to be vertically coupled within bulb housings 74. These types of florescent bulbs are also often mounted in high locations such as above stairways. Note FIG. 1.

Figure 2:
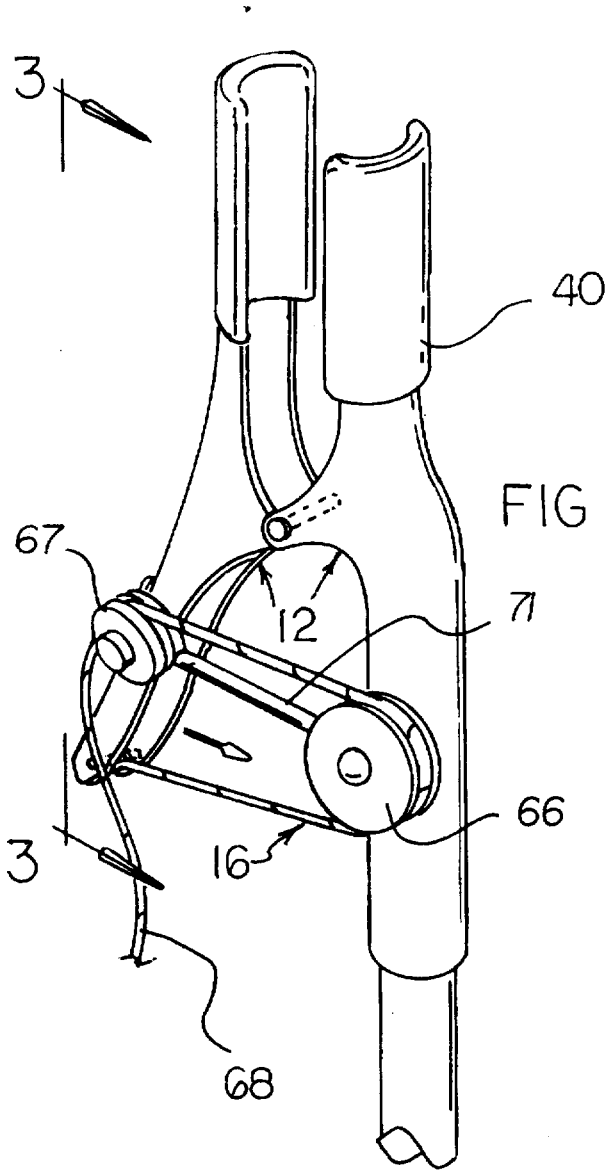
FIG. 2 is an isolated perspective view of the gripper assembly of the apparatus.
Figure 3:
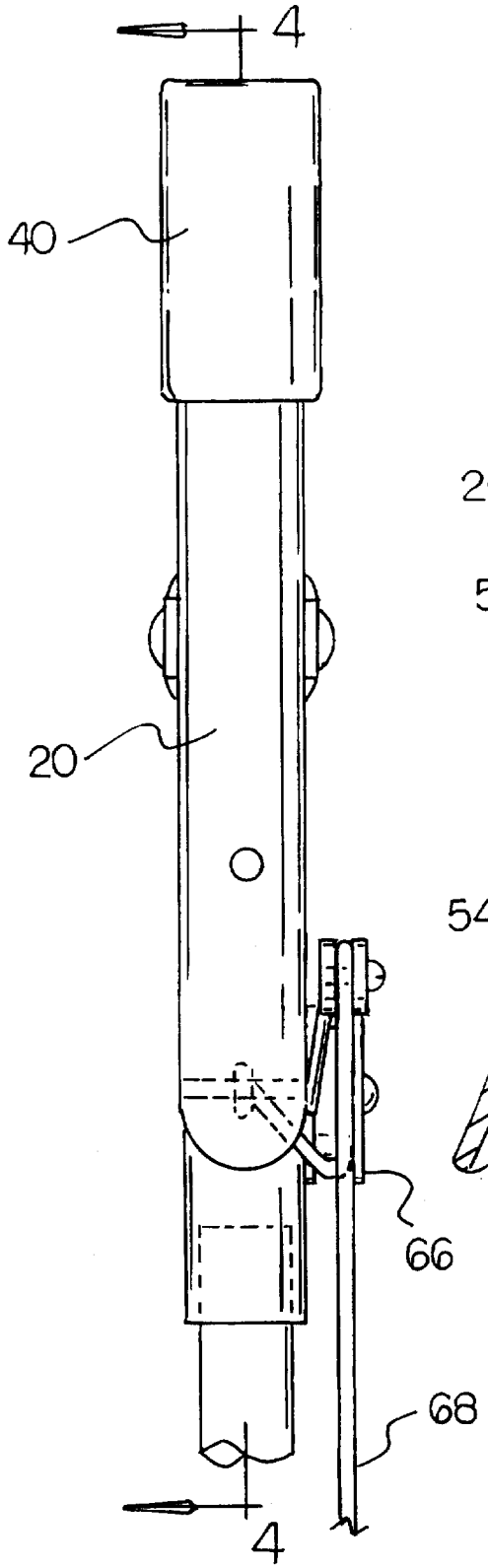
FIG. 3 is a perspective view of the gripper assembly taken along section line 3—3 of FIG. 2.
Figure 4:
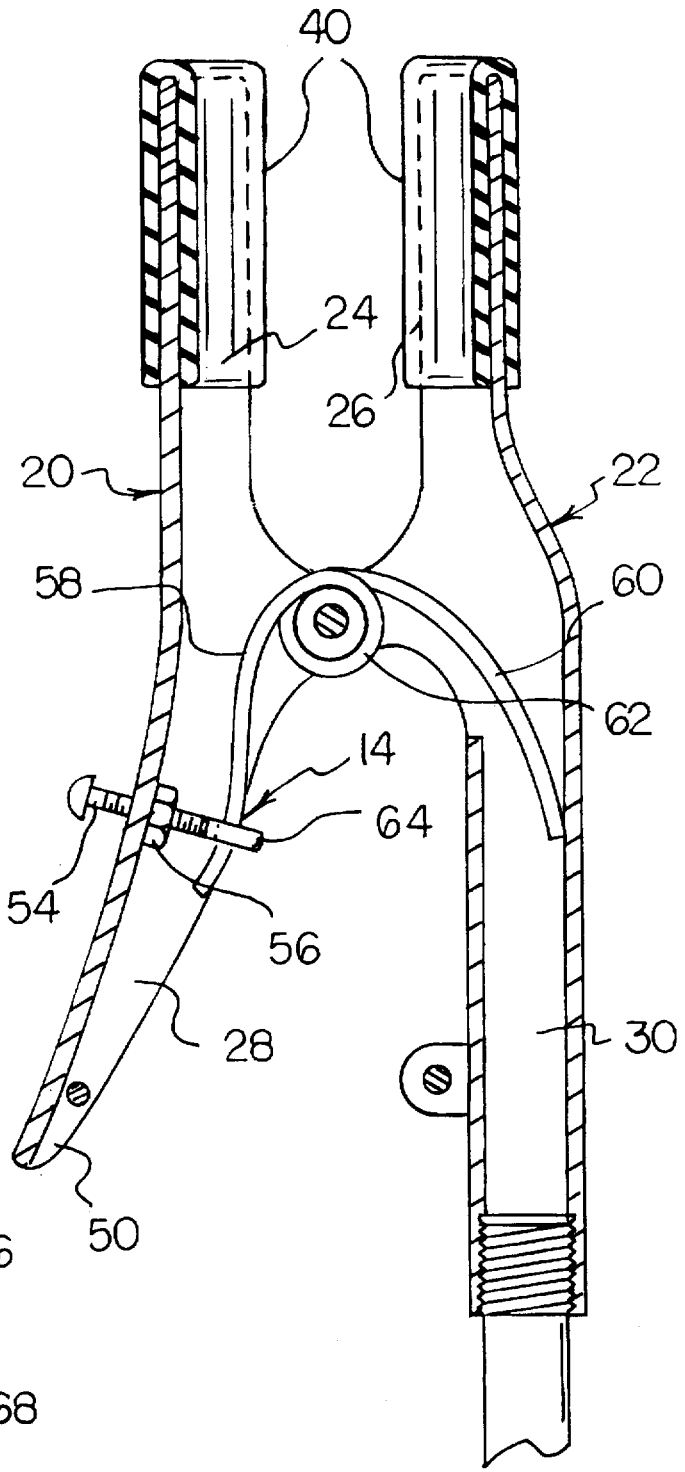
FIG. 4 is a cross sectional view taken along section line 4—4 of FIG. 3.

The gripper assembly 12 includes a first gripper member 20 and a second gripper member 22. The gripper assembly 12 is preferably fabricated of plastic. In alternate embodiments of the apparatus the gripper assembly is fabricated of steel. The gripper assembly is about 12 inches long and eight inches wide. Each gripper member includes a jaw section 24, 26, a handle section 28, 30 and a central coupling section 32, 34. Each jaw section has an generally linear axis and is formed in a an elongated semicylindrical configuration with an outboard end 36, 38, a concave inner surface and a convex outer surface. Note FIG. 2.

A soft rubber jaw cushion 40 is tightly coupled around the outboard end of each jaw section. The soft rubber jaw cushions follow the contour of the jaw sections. When utilizing the apparatus the axes of the recesses of the jaw cushions are positioned vertically to permit convenient grasping of a florescent tube. The jaw cushions are sized and shaped to securely grip a tube within the recesses. The soft rubber construction of the jaw cushions prevent damage to a gripped bulb. Each central coupling section is formed of opposing extension members 42, 44. Each extension member includes a hole extending through it. A pivot pin 46 pivotally couples the opposing extension members of each central couples section. Note FIGS. 1–4.

The handle section 30 of the second gripper member is formed in a hollow cylindrical configuration with a lower end including internal screw threads 48. The handle section of the second gripper member has an axis parallel to the axis of the jaw section of the second gripper member. The handle section 28 of the first gripper member is formed in a semicylindrical configuration and has a curved axis angled outwardly with respect to the axis of the jaw section of the first gripper member. The handle section 28 of the first gripper member is also angled outwardly with respect to the handle section of the second gripper member. This configuration provides ample clearance area to permit wide opening of the jaw sections by pivoting the handle sections toward each other. The handle section 28 of the first gripper member includes a lower end 50 and a central threaded hole. Note FIGS. 2–4.

The tension adjustment assembly 14 includes a tension spring 52, an adjustable bolt 54 and a nut 56. The tension spring includes first and second linear end portions 58, 60 and a coiled central portion 62. The coiled central portion of the tension spring is positioned around the pivot pin 46 and secured between the extension members 42, 44. The second linear end portion is securely positioned within the handle section of the second gripper member. The adjustable bolt 54 has a head and an inboard end and is coupled through the threaded hole of the handle section of the first gripper member. The nut 56 is positioned around the bolt to secure it in place. The inboard end of the bolt includes a separate U-shaped member 64. The first linear end portion 58 is wedged within the U-shaped member 64. The tension spring 52 functions to urge the jaws toward each other and the handles away from each other. The adjustable bolt 54 permits a user to change the distance between the jaws in the closed position. This is accomplished by turning the bolt. Turning the bolt in a counterclockwise direction decreases the distance between the jaws. Turning the bolt in a clockwise direction increases the distance between the jaws. Note FIG. 4.

Figure 5:
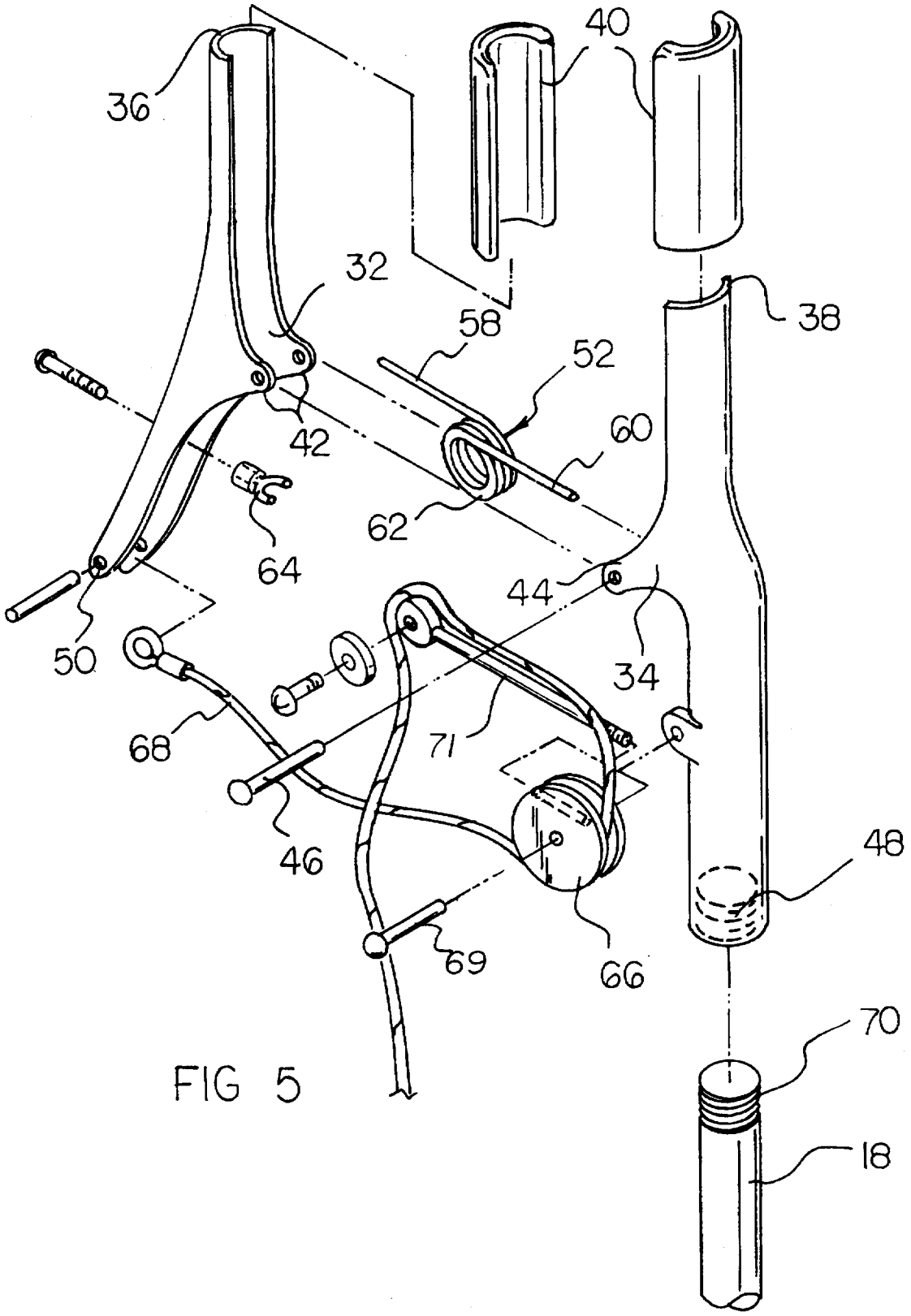
FIG. 5 is a separated perspective view illustrating the positioning of the various components of the apparatus with respect to each other.

The pulley assembly 16 includes a large pulley wheel 66, a small pulley wheel 67 and a braided wire cable 68. The large pulley wheel 66 is rotatably coupled to the handle section 30 of the second gripping member by an axle 69. The large pulley wheel has a rod 71 with an outer end extending from it. The small pulley wheel is affixed to the outer end of the rod a short distance from the first gripper member. The cable has a first end and a second end. The first end includes a loop and is coupled to the lower end 50 of the handle section of the first gripper member by a rod. The cable is wound around both the large and small pulley wheels 66, 67. Note FIG. 3. In an operative orientation a user pulls the cable thereby urging the first and second handle sections toward each other. This action pivots the jaw sections apart into an open orientation. Note FIGS. 4 and 5.

The extension pole 18 is formed in an elongated generally cylindrical configuration with an upper end which includes external screw threads 70. The pole has a lower end including a handle. In an operative orientation the upper end of the pole is threadedly coupled within the lower end of the handle section 30 of the second gripper member. The pole is between four and twenty feet long to enable users to access ceiling mounted florescent bulbs with the apparatus. To remove a florescent tube from a ceiling mounted florescent tube housing the user first pulls the cord causing the jaw sections to pivot into an open orientation. The jaw sections of the gripper assembly are then positioned around the tube and the cord is gradually released. The jaw sections then firmly grasp the tube so that extraction of the bulb may be accomplished. Replacement of a florescent bulb may be accomplished in a similar manner. Note FIGS. 1 and 2.

In alternate embodiments the present invention is utilized to grasp tree branches during pruning activities. The tree branches are first secured within the jaw sections of the apparatus and then cut. The user can then guide the branch to a safe resting surface. This prevents cut branches from falling on people, cars, plants, etc.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved florescent light bulb changing device adapted for use in association with at least one vertically positioned florescent light tube, each florescent light tube being coupled within a florescent light tube housing, the apparatus comprising, in combination:

a gripper assembly including a first gripper member and a second gripper member, each gripper member including a jaw section, a handle section and a central coupling section, each jaw section having an axis and being formed in an elongated semicylindrical configuration with an outboard end, a concave inner surface and a convex outer surface, a soft rubber jaw cushion being tightly coupled around each jaw section, the soft rubber jaw cushions following the contour of the jaw sections, the jaw sections being sized and shaped to securely grip a florescent light tube therewithin, the soft rubber construction of the jaw cushions preventing damage to a gripped florescent light tube, each central coupling section being formed of opposing extension members, each extension member including a hole extending therethrough, a pivot pin pivotally coupling the opposing extension members of each central coupling section;

the handle section of the second gripper member being formed in a hollow cylindrical configuration with a lower end including internal screw threads, the handle section of the second gripper member having an axis parallel to the axis of the jaw section of the second gripper member, the handle section of the first gripper member being formed in a semicylindrical configuration and having a curved axis angled outwardly with respect to the axis of the jaw section of the first gripper member, the handle section of the first gripper member including a lower end and a central threaded hole;

a tension adjustment assembly including a tension spring, an adjustable bolt and a nut, the tension spring including first and second linear end portions and a coiled central portion, the coiled central portion of the tension spring being positioned around the pivot pin and secured between the extension members, the second linear end portion being securely positioned within the handle section of the second gripper member, the adjustable bolt having a head and an inboard end and coupled through the threaded hole of the handle section of the first gripper member, a nut being positioned around the bolt to secure it in place, the inboard end including a separated U-shaped member, the first linear end portion being wedged within the U-shaped member, the tension spring functioning to urge the jaws toward each other and the handle sections away from each other, the adjustable bolt permitting a user to change the distance between the jaws by turning the bolt;

a pulley assembly including a large pulley wheel, a small pulley wheel and a braided wire cable, the large pulley wheel being rotatably coupled to the handle section of the second gripping member, the large pulley wheel having a rod with an outer end extending therefrom, the small pulley wheel being affixed to the outer end of the rod a short distance from the first gripper member, the cable having a first end and a second end, the first end being coupled to the lower end of the handle section of the first gripper member, the cable being wound around the large and small pulley wheels, in an operative orientation a user pulling the lower end of the cable thereby urging the first and second handle sections toward each other, this action thereby pivoting the jaw sections apart into an open orientation; and an extension pole formed in an elongated generally cylindrical configuration with an upper end including external screw threads, in an operative orientation the upper end of the pole being threadedly coupled within the lower end of the handle section of the second gripper member, the pole being of sufficient length to enable users to access ceiling mounted florescent bulbs with the apparatus.

2. A florescent light bulb changing device comprising:

a gripper assembly including first and second gripper members, each gripper member including a jaw section, a handle section and a central coupling section, the central coupling section of the gripper members being pivotally coupled to each other; and a tension spring including first and second linear end portion and a coiled central portion, the first linear end portion being positioned within the handle section of the first gripper member, the second linear end portion being positioned within the handle section of the second gripper member, the tension spring function to urge the jaws toward each other an adjustable bolt having a head and an inboard end and coupled through the handle section of the first gripper member, a nut being positioned around the bolt to secure it in place, the inboard end including a separate U-shaped member coupled to the first linear end portion of the tension spring, the adjustable bolt permitting a user to change the distance between the jaws by turning the bolt.

3. The florescent light bulb changing device as set forth in claim 2 and further including:

a soft rubber jaw cushion being coupled around the each jaw section, each soft rubber jaw cushion including a concave recess, the jaw cushions being sized and shaped to securely grip a florescent light tube within the recesses thereof, the soft rubber construction of the jaw cushions preventing damage to a gripped florescent light tube.

4. The florescent light bulb changing device as set forth in claim 2 and further including:

an extension pole formed in an elongated generally cylindrical configuration with an upper end, in an operative orientation the upper end of the pole being coupled to the handle section of the second gripper member, the pole being of sufficient length to enable users to access ceiling mounted florescent bulbs with the apparatus.

* * * * *